United States Patent [19]

DeYoung

[11] Patent Number: 4,719,838

[45] Date of Patent: Jan. 19, 1988

[54] STRAND CARRIER FOR A BRAIDING MACHINE

[76] Inventor: Simon A. DeYoung, 5132 Mayview Rd., Lyndhurst, Ohio 44124

[21] Appl. No.: 20,663

[22] Filed: Mar. 2, 1987

[51] Int. Cl.[4] ..... D04C 3/18

[52] U.S. Cl. ..... 87/57; 87/21; 87/55

[58] Field of Search ..... 87/21, 22, 55–57

[56] References Cited

U.S. PATENT DOCUMENTS

| | | | |
|---|---|---|---|
| 3,359,848 | 12/1967 | Ostermann | 87/56 |
| 3,408,893 | 11/1968 | Singh | 87/21 |
| 3,817,147 | 6/1974 | Richardson | 87/57 |
| 3,882,757 | 5/1975 | Weatherby | 87/57 |
| 4,529,147 | 7/1985 | Bull et al. | 87/57 X |

*Primary Examiner*—John Petrakes

*Attorney, Agent, or Firm*—Body, Vickers & Daniels

[57] ABSTRACT

A strand carrier for a braiding machine enables the braiding machine to operate at greater speeds and with fewer and shorter interruptions for replenishment of strand supply or for other service. The carrier is an enlongated assembly comprising a longitudinal sequence of spring, bobbin, clutch, and tension controlling components, and is radially symmetrical about the longitudinal axis and rotatably mounted at one end thereof to a braiding machine shuttle.

15 Claims, 12 Drawing Figures

STRAND CARRIER FOR A BRAIDING MACHINE

This invention pertains to the art of braiding machines and, more particularly, to a strand carrier for carrying and controllably releasing a strand in a braiding machine empolying a plurality of strand carriers to braid a corresponding plurality of strands around a workpiece.

BACKGROUND OF THE INVENTION

Braiding machines have long been used in industry, for example, to braid metallic wire into electrical or electronic cable as a protective armor or into hydraulic hose and cordage as a load bearing structure or into rope, either metal or non-metallic.

One of such braiding machines has been known as a may-pole type machine wherein shuttles carrying a bobbin are moved by horn gears or notched rotors on a deck with all of the shuttles following alternating semi-circular or arcuate paths around the braiding point. Half the shuttles travel in one direction around the braiding point following one alternating path while the other half of the shuttles travel in the opposite direction around the braiding point following another alternating path which crosses the first path at each alternating direction. As the two sets of shuttles travel in opposite directions around the braiding point each crossing the path of the other, strands leaving the bobbins are interwoven as they converge to the braiding point. With such maypole type braiders, the bobbins are normally rotatably mounted on an axis perpendicular to the path of movement of the shuttles and parallel to the axis of the workpiece. As such, during one half of the time, each bobbin is moving radially away from the workpiece and the other half of the time radially towards the workpiece at a rate sometimes faster than the strand is being taken up by the workpiece.

Associated with each bobbin is a strand carrying assembly. The strand carrying assembly is carried by the shuttle and includes both a tension controlling mechanism and a clutch mechanism. The tension controlling mechanism functions to maintain a constant tension on the strand as it leaves the bobbin and converges to the braiding point notwithstanding the movement of the bobbin toward and away from the workpiece. The clutch mechanism restrains the bobbin from rotating and dispensing a strand and periodically releases the bobbin when the tension controlling mechanism reaches the limit of its operation. Release of the bobbin permits additional strand to be unwound from the bobbin and withdrawn from the strand carrier through the tension controlling mechanism.

Heretofore, the bobbin, clutch and tension controlling mechanism have been cantilevered on the shuttle with the clutch and slack take-up mechanism positioned at one radial side of the bobbin, that is unsymmetrical relative to the bobbin axis. Because of this non-symmetry and the crowding of all the assemblies into a small space so as to make a compact braider, the entire assembly is fixedly mounted on the shuttle with the clutch and tension mechanism in a predetermined radial position so that the bobbins and associated mechanisms moving in opposite directions can readily pass in the limited space available without interferring one with the other. The diameter and capacity of the bobbin is limited by the space occupied on the shuttle by the clutch and tension controlling mechanisms. A limited bobbin capacity causes an inefficient frequency of interruptions to replenish strand supplies on the bobbins.

In these machines, the bobbin and associated mechanisms are subjected to two different types of forces as the shuttle moves from one semi-circular path to the other; namely, constantly reversing rotational forces about the bobbin axis and constantly reversing centrifugal forces on the cantilevered portion of the assembly. These constantly reversing forces create large stresses in the various parts of the braiding machine, which if too high will ultimately fatigue the materials resulting in cracks forming, and if the cracks are not discovered in time, will result in breakage and damage to the entire machine. These stresses are a square function of the speed of rotation of the shuttles around the workpiece. The maximum speed of braiding is severely limited by the need to limit this speed of rotation and thus the rate of braiding the workpiece.

Due to the high reversing rotational and centrifugal forces on the bobbin assemblies, failures occur if extremely strict maintenance procedures are not followed. In some cases failed parts between other moving parts cause an entire wipe-out of the braider. Such wipe-outs are extremely expensive not only in the repair of the parts, but in the down time required to repair the braider and its intended braiding operation.

A further problem with existing maypole type braiders has been the time required to replace a bobbin when its strand has been entirely dispensed. With existing machines it has been necessary to stop the machine, remove the bobbin, install a new bobbin, and then guide its strand through the tension controlling mechanism to the workpiece. Advancing th strand through the take-up mechanism while the carrying assembly is in the braider consumes a substantial amount of time, which in a 24 or 32 strand braider can add up to a substantial amount of down time.

Other disadvantages of existing strand carriers arise in the tension controlling mechanisms. In order to fit on a shuttle adjacent the bobbin and other components the tension controlling mechanism is a laterally compact, generally elongated structure fixed at one end to the shuttle. A strand roller is slidable in a guideway extending the length of the structure and is spring biased toward the shuttle end. The strand extends from the bobbin laterally across the shuttle to the sliding strand roller, which turns the strand to extend toward the other end where it exits the carrier. Tension in the strand extending around the sliding strand roller urges the roller against the spring biasing force. A generally constant rate of strand output from the carrier is maintained by sliding movement of the strand roller in the guideway as permitted by the spring biasing force in response to changes in external strand tension. Sliding strand rollers are known to comprise a pulley mounted on an axle extending laterally from a shoe carried in the guideway. This arrangement causes strand tension at the pulley to transmit a bending moment through the axle and into the shoe, which is then undesirably forced against the sides of the guideway instead of being forced only in the direction of movement along the guideway. An imbalance of forces at the sliding strand roller causes friction which not only decreases efficienty of operation, but also results in overheating of the machine despite efforts to lubricate the frictionally engaged moving parts. Furthermore, sliding strand rollers are known to hesitate or jam in the guide way and thus fail to maintain the desired tension in the strand, which if too high can break either the strand or the machine, and if too low causes slack to become entangled in other strands or moving parts.

THE INVENTION

The present invention contemplates a new and improved strand carrier and its associated mechanisms which overcomes all of the above referred to difficulties and others, and provides a strand carrying assembly where the bobbin can be of a larger diameter, where the bobbin and its associated mechanisms are completely symmetrical about the axis of the bobbin, and where replacing empty bobbins with full bobbins can be done much more quickly.

In accordance with the broadest aspect of the present invention, there is provided a strand carrier assembly comprised of a bobbin rotatable about an axis, and a clutch and tension controlling mechanism positioned axially beyond one end of the bobbin and substantially symmetrical to its axis.

Further in accordance with the invention, means are provided for supporting the assembly on the shuttle of a braiding machine freely rotatable on the axis of the bobbin.

Further in accordance with the invention a strand carrying assembly for a braiding machine is provided comprised of a bobbin supporting a supply of strand to be braided, means supporting the bobbin for rotation about an axis and symmetrical to the axis, clutch means and tension controlling means in axial alignment with the bobbin and symmetrical about the axis, the clutch means normally restraining the bobbin from rotation and the tension controlling means operable when it has reached the limit of its movement to release the clutch means and permit withdrawal of strand from the bobbin.

Further in accordance with the invention, a strand carrier assembly for a braiding machine is provided comprised of: a bobbin having an axis of rotation; a base member symmetrical about the axis and rotatably supporting the bobbin: an end member symmetrical relative to the axis and fixedly spaced relative to the base member and an end of the bobbin: a fixed clutch member symmetrical relative to the axis and associated with the bobbin; a movable clutch member symmetrical about the axis: means biasing the movable clutch member toward the fixed bobbin member; a movable tensioning member symmetrical about the axis, and positioned between the movable clutch member and the end member; the tensioning member at a predetermined point of movement toward the end member acting to move said movable clutch member away from the fixed clutch member; means biasing the tensioning member away from the end member and a plurality of strand pulleys on the end member and tensioning member with the strand alternating between pulleys whereby increasing tension on a strand moves the tensioning member toward the end member and ultimately moves said movable clutch member.

Further in accordance with another aspect of the invention there is provided an elongated strand carrier assembly having a longitudinal sequence of radially symmetrical components including a bobbin, a spindle, a clutch, and a tension controlling mechanism. A wound supply of strand extends radially outwardly from the bobbin unobstructed by the other components.

Further in accordance with the invention there is provided a tension controlling mechanism for a braiding machine strand carrier having an axially fixed member, an axially movable member spring biased away from the axially fixed member, each member being radially symmetrical about the carrier axis and having a circumferentially extending, radially symmetrical arrangement of strand pulleys guiding the strand alternately between the members such that tension applied to the strand urges the axially movable member toward the axially fixed member with a force balanced in the axial direction.

The principal object of the present invention is to provide a new and improved strand carrier for a braiding machine which enables the braiding machine to operate at greater speeds and with less down time for service.

Another object of the invention is to provide a strand carrier which minimizes the dynamic rotational forces produced within the carrier and transmitted to a braiding machine as the strand carrier is revolved around a workpiece by the braiding machine.

Another object of the invention is to provide a strand carrier for a braiding machine which is comprised of a single elongated assembly in order to facilitate replacement of the carrier or its component parts and thereby to reduce service time at a carrier location on a braiding machine.

Another object of the invention is to provide a new and improved strand carrier for a braiding machine which is freely rotatable in response to dynamic forces developed as the carrier is moved around a workpiece by a braiding machine, and which thereby minimizes resistance to said forces within the carrier and further minimizes transmission of said forces to the braiding machine.

Another object of the invention is to provide an elongated strand carrier which is substantially radially symmetrical.

Still another object of the invention is to provide a new and improved strand carrier which is capable of carrying a greater supply of wound strand material.

A further object of the invention is to provide a tension controlling mechanism for a braiding machine strand carrier which operates smoothly so as to be immediately and continuously responsive to changes in strand tension.

Further objects and advantages of the invention will become apparent from the following detailed description of a preferred embodiment thereof and from the accompanying drawings.

DESCRIPTION OF A PREFERRED EMBODIMENT

Figure 1:
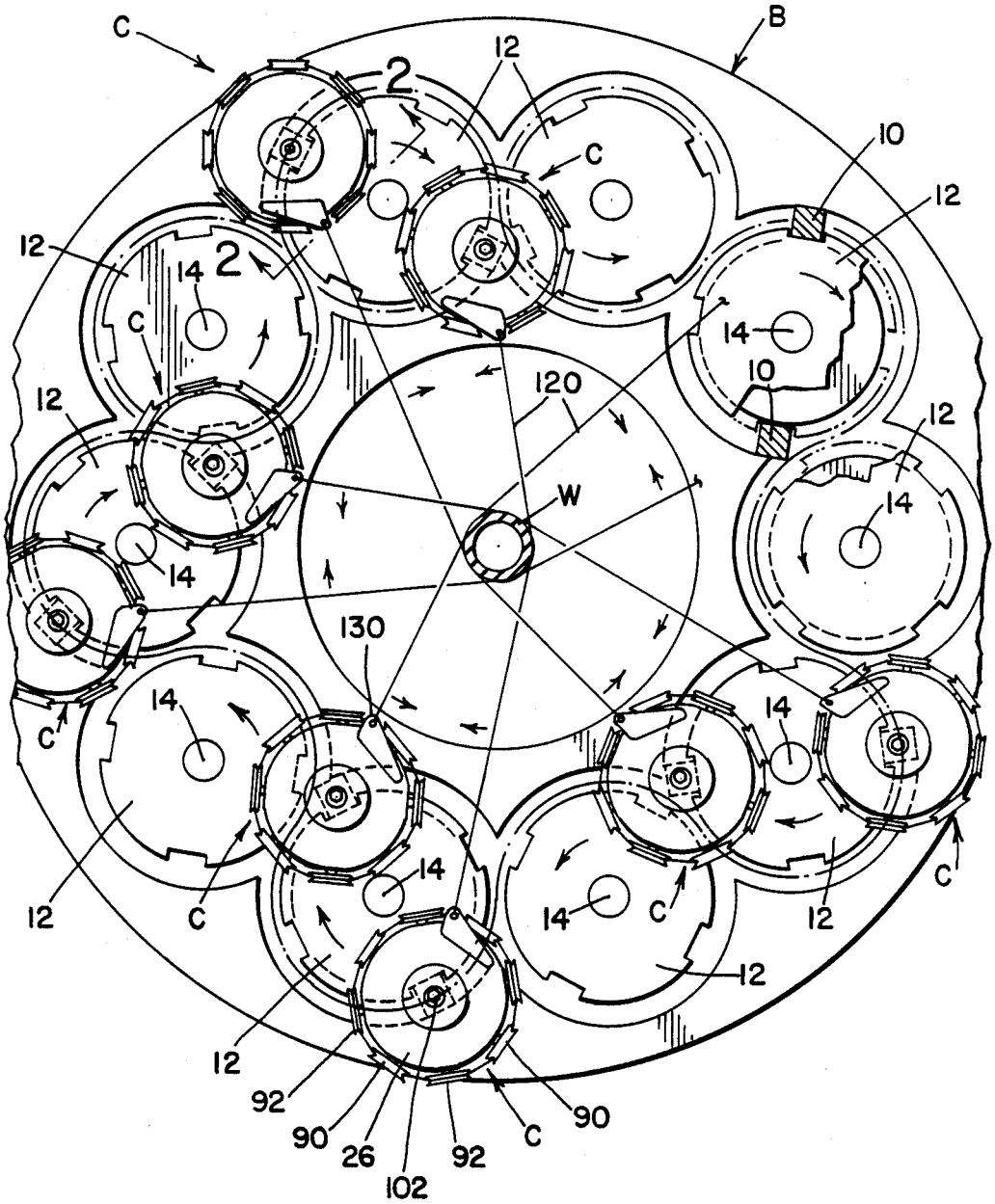
FIG. 1 is a plan view of a braiding machine showing a partial cut away section and including a plurality of strand carriers formed according to the present invention.

Referring now to the drawings wherein the showings are for the purposes of illustrating a preferred embodiment of the invention only and not for the purposes of limiting same, FIG. 1 shows in plan view a braiding machine B, and a plurality of strand carriers C. Strand carriers C are transported on shuttles 10 by braiding machine B in generally circumferential paths around workpiece W by notched rotors 12. Rotors 12 are disposed in a circumferential series and rotate about rotor axes 14 each in a direction opposite to an adjacent rotor. Pairs of strand carriers C are shown to be moved in opposite directions by a rotor 12 with one strand carrier C following a semi-circular path along one side of a rotor, and with another strand carrier C moving oppositely in a semi-circular path around the other side of the same rotor. Each shuttle 10 with a strand carrier C is released from a rotor 12 at the end of each semi-circular path and is simultaneously received by a next rotor 12 to follow an alternate semi-circular path therearound. Successive alternate semi-circular paths taken by each shuttle 10 around successive rotors 12 complete a revolution by the mounted strand carrier C around workpiece W, with oppositely moving strand carriers C controllably releasing strands 120 under tension to form a braided pattern of strands 120 wrapped around workpiece W. The operation of braiding machine B is known in the art and does not form a part of the present invention. Further description of braiding machine B will therefore be limited to the fact that the alternating semi-circular paths taken by shuttles 10 around successive adjacent rotors 12 cause shuttles 10 constantly to rotate with respect to rotor axes 14 and workpiece W, and further cause shuttles 10 to move alternately toward and away from workpiece W over a distance substantially equal to the diameter of the rotors 12.

Figure 2:
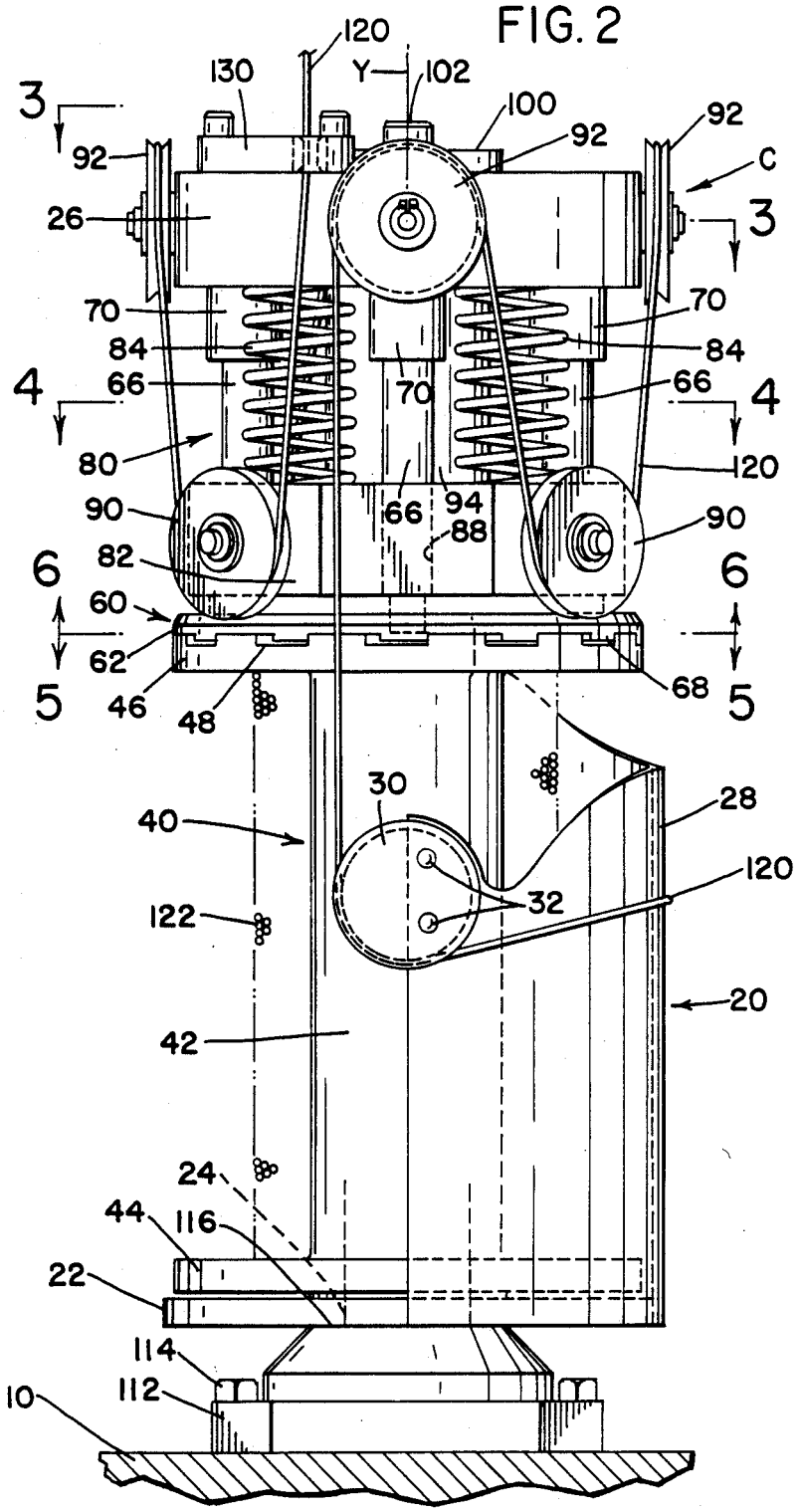
FIG. 2 is a side view of a strand carrier according to the invention taken on line 2—2 of FIG. 1.

Referring now to FIG. 2 there is shown a side view of of strand carrier C according to the present invention. Strand carrier C is comprised generally of a spindle 20, bobbin 40, clutch 60 and tension controller 80. Strand carriers usually extend horizontally away from a vertical shuttle, but for the purpose of illustration strand carrier C will be described with reference to vertical axis Y and horizontally oriented shuttle 10.

Figure 10A:
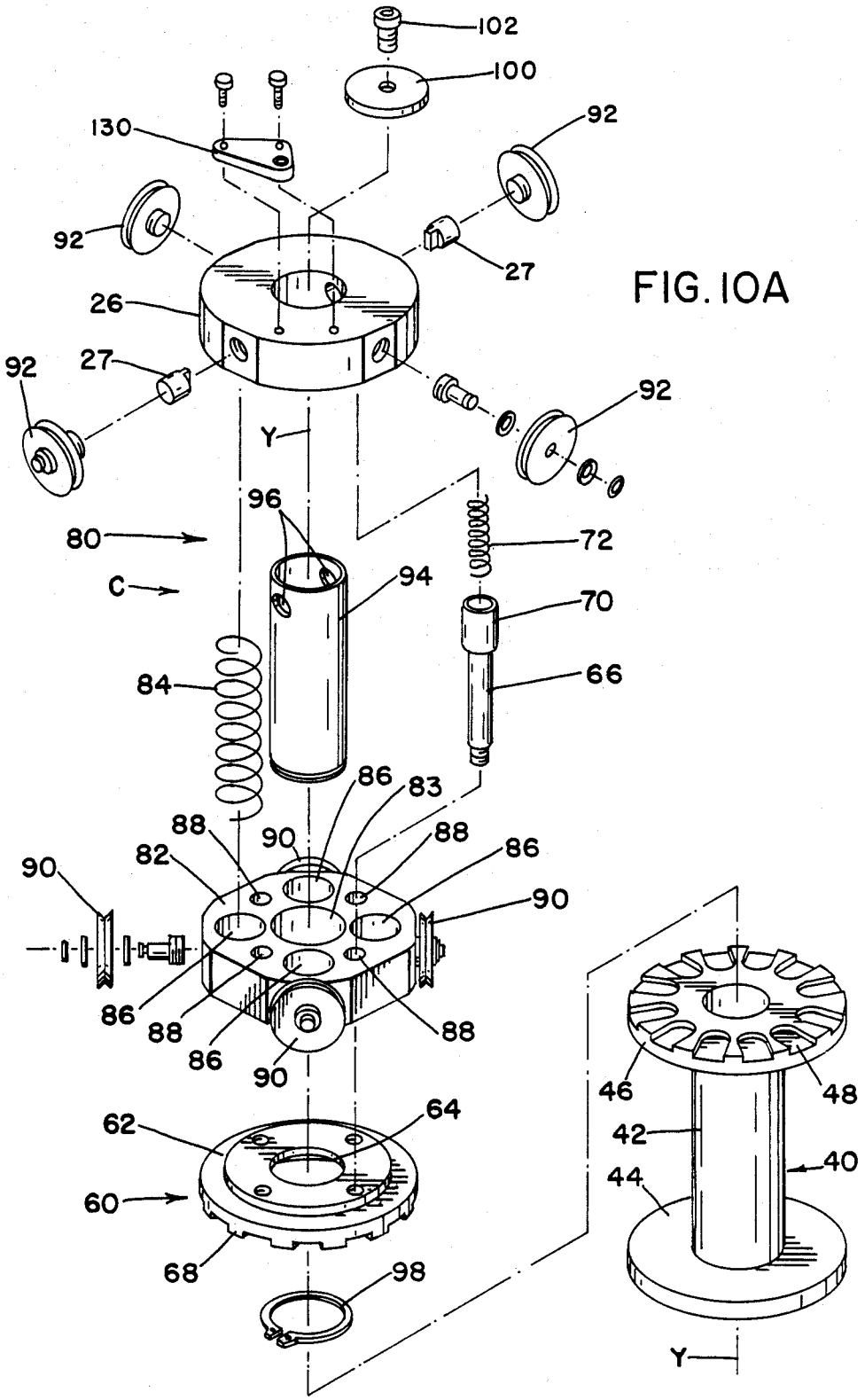
FIGS. 10A and 10B comprise an exploded perspective view of the components of a strand carrier according to the invention: and, FIG. 11 is a partial schematic view of the path taken by a strand on a strand carrier according to the invention.
Figure 10B:
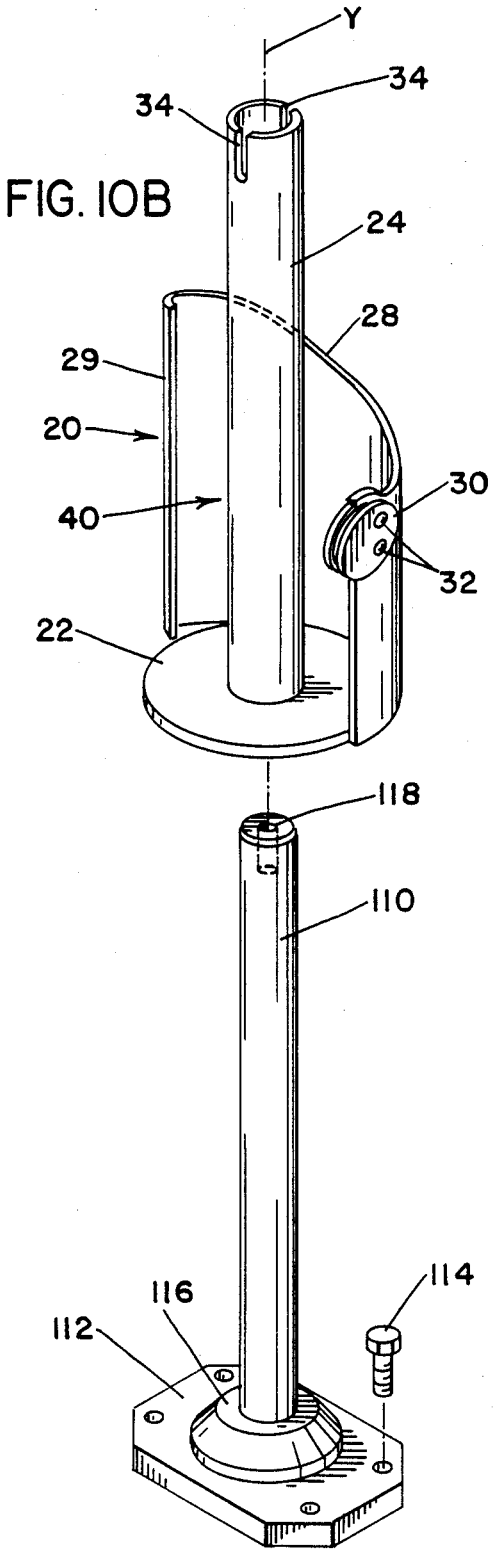

Spindle 20 comprises base 22, spindle shaft 24, end member 26, shell 28 fixed to the outer edge of base 22, and lower strand guide 30 mounted to shell 28 by rivets 32. End member 26 is rigidly fixed to spindle shaft 24 with lugs 27 fitted through slotted openings 34 as best seen in FIGS. 10A and 10B. Shell 28 is an axially extending arcuate sector connected at its lower edge, to base 22, and extending approximately 180° circumferentially around central axis Y and bobbin 40. Shell 28 has strand receiving surface 29 formed at one circumferential extremity thereof, and lower strand guide 30 rigidly mounted at the other radial extremity thereof. In accordance with the invention, spindle 20 is substantially radially symmetrical about central axis Y. A greater degree of radial symmetry can be obtained with a greater circumferential extent of shell 28 in an alternate embodiment to be described hereinafter.

Bobbin 40 comprises tubular spool 42, lower flange 44, and upper flange 46. Bobbin 40 is received on spindle 20 with flange 44 resting on spindle base 22 and spindle shaft 24 received within tubular spool 42. In accordance with the invention bobbin 40 is radially symmetrical about central axis Y and is freely rotatable about central axis Y and spindle shaft 24. Associated with upper flange 46 are recesses 48. Recesses 48 are elements of clutch 60.

Clutch 60 is provided to releasably restrain bobbin 40 from rotation about spindle shaft 24. In the preferred embodiment clutch 60 comprises clutch plate 62, passage 64, clutch posts 66, raised teeth 68, and recesses 48 formed in upper flange 46 of bobbin 40. Clutch plate 62 is positioned above upper flange 46 with spindle shaft 24 received through passage 64. Clutch posts 66 extend vertically upward from clutch plate 62 towards end member 26 of spindle 20. Post heads 70 are formed at the upper ends of clutch posts 66. Post heads 70 have a slightly greater diameter than clutch posts 66 and take a hollow cylindrical shape to partially receive clutch springs 72. Clutch plate 62 is spring biased axially away from end member 26 and towards bobbin 40 through clutch posts 66 by clutch springs 72. Raised teeth 68 are receivable within recess 48 to prevent relative rotation between clutch plate 62 and bobbin 40. In accordance with the invention clutch 60 is substantially radially symmetrical about central axis Y.

Figure 3:
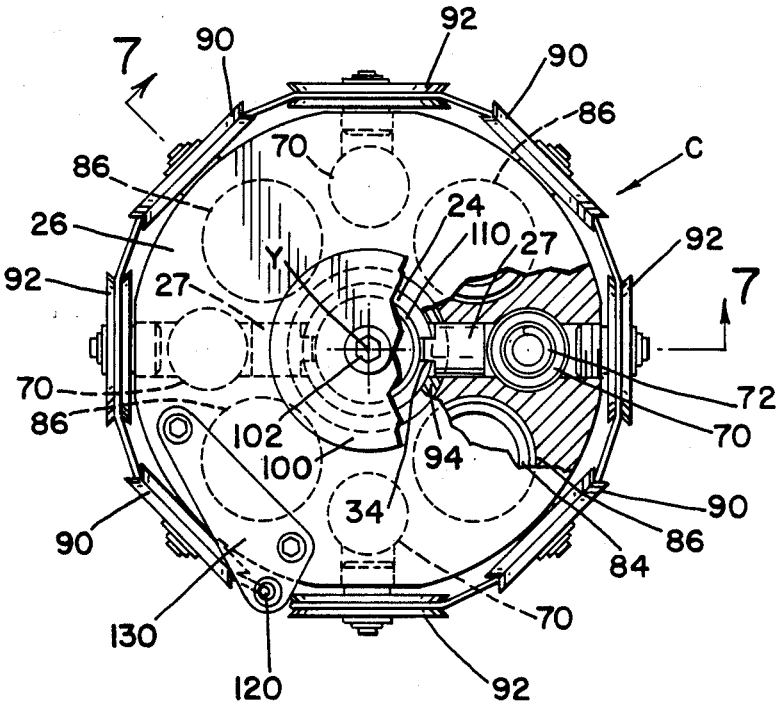
FIG. 3 is a plan view taken on line 3—3 of FIG. 2.
Figure 4:
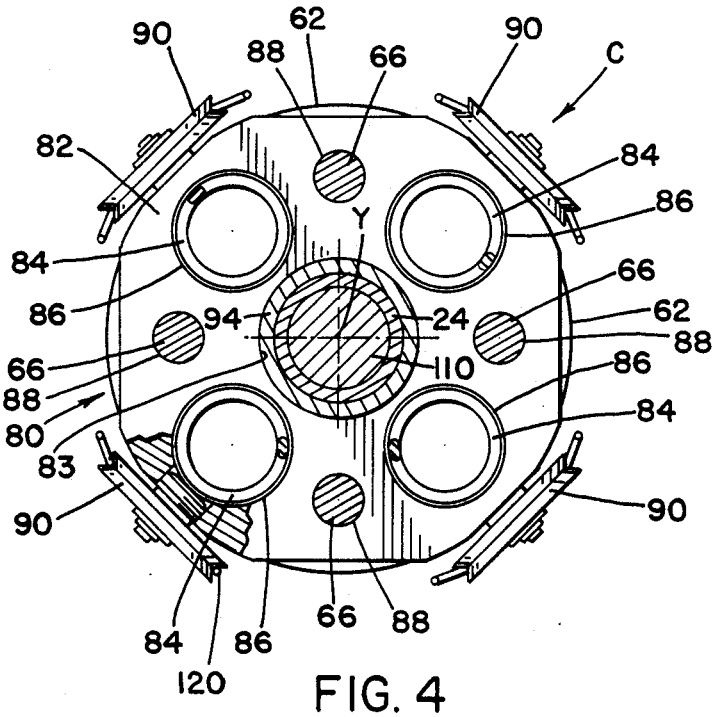
FIG. 4 is a plan view taken on line 4—4 of FIG. 2.
Figure 5:
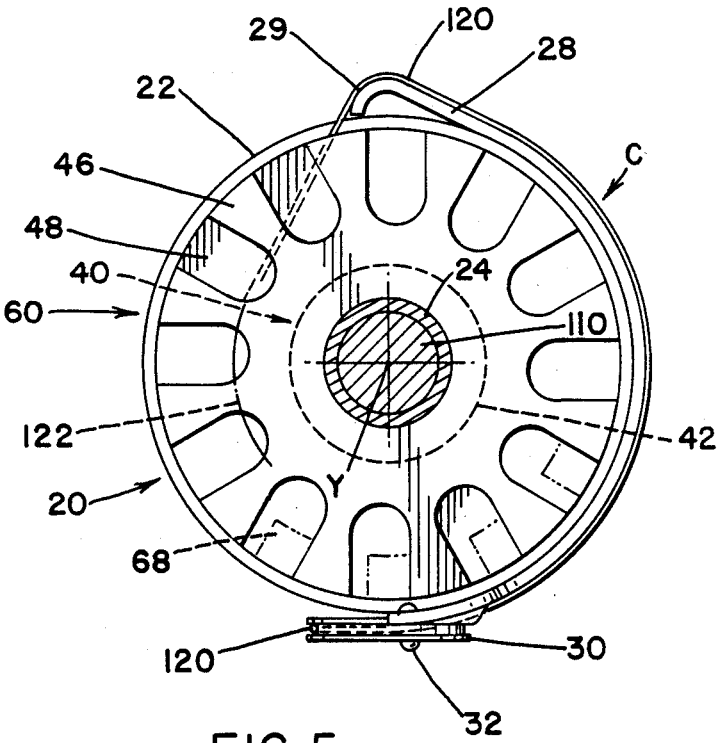
FIG. 5 is a plan view taken on line 5—5 of FIG. 2.
Figure 6:
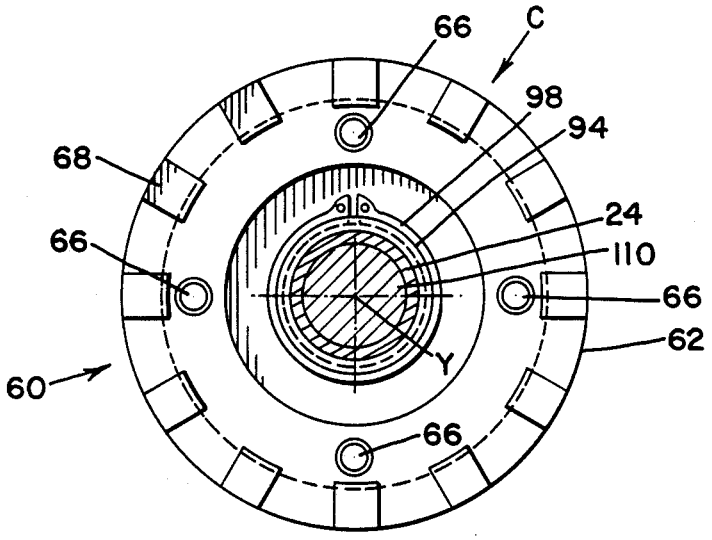
FIG. 6 is a bottom plan view taken on line 6—6 of FIG. 2.
Figure 7:
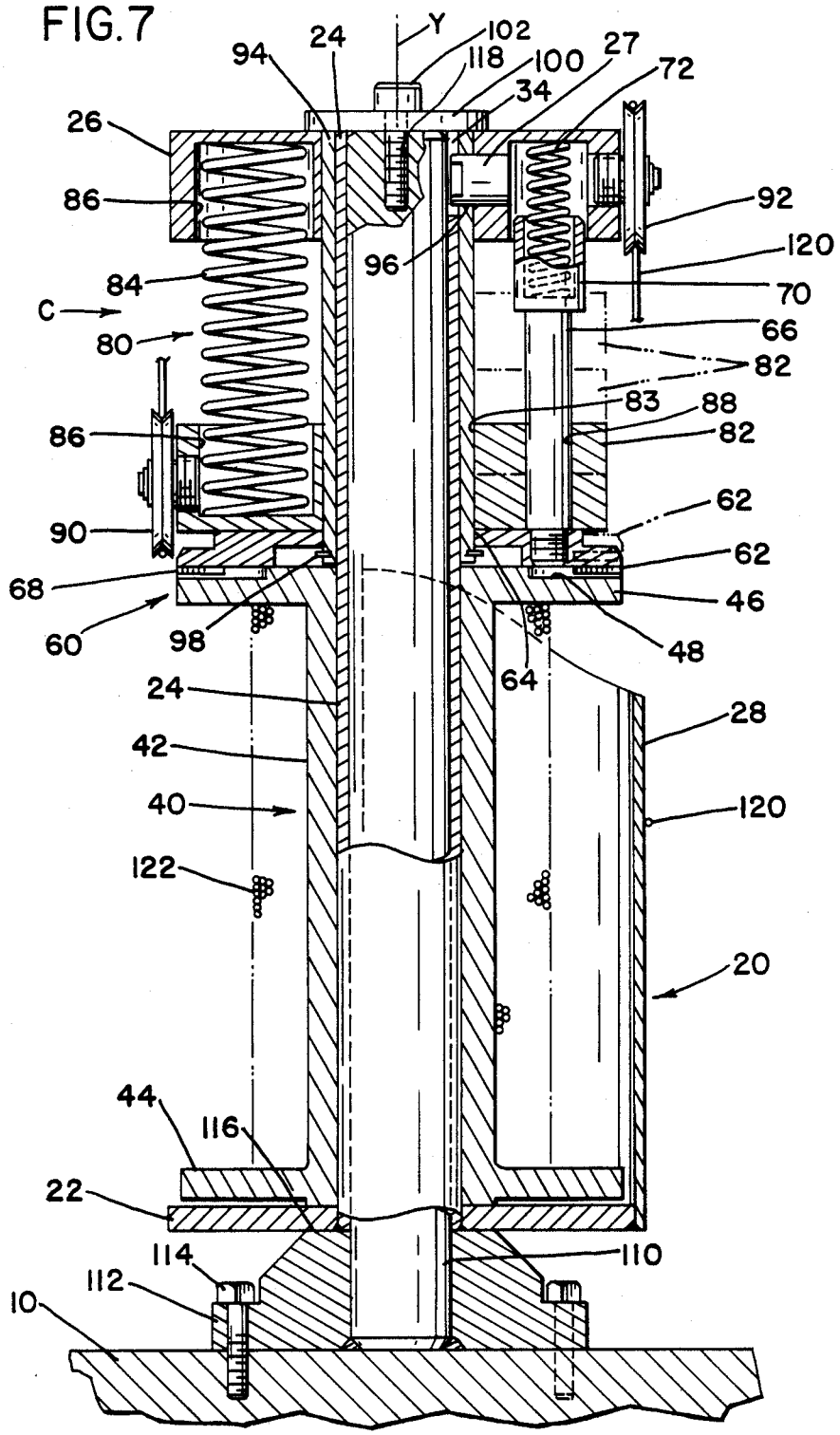
FIG. 7 is a partial cross-sectional view taken on line 7—7 of FIG. 3.

Tension controller 80 maintains a substantially constant tension in the strand as the braiding machine moves the strand carrier alternately toward and away from the workpiece. In the preferred embodiment tension controller 80 comprises floating member 82, main springs 84, lower strand pulleys 90, upper strand pulleys 92, and sleeve 94. As best seen in FIG. 7, sleeve 94 is closely received over spindle shaft 24. Floating member 82 is axially slidable along sleeve 94 through aperture 83. Main spring pockets 86 are formed in floating member 82 and in end member 26 of spindle 20. Main springs 84 are held in main spring pockets 86 to axially bias floating member 82 away from end member 26. Clutch post passages 88 extend through floating member 82 to permit passage therethrough of clutch posts 66. Clutch post passages 88 have a lesser diameter than post heads 70 such that upward axial movement of floating member 82 against the biasing force of main springs 84 will eventually cause floating member 82 to contact and lift post heads 70 and clutch posts 66 upward along axis Y against the biasing force of clutch springs 72. Lower pulleys 90 and upper pulleys 92 are rotatably mounted on floating member 82 and end member 26 in a circumferentially staggered sequence. Sleeve apertures 96 are formed in sleeve 94 to permit lugs 27 to fix end member 26 to spindle sleeve 24 as described above. In accordance with the invention tension controller 80 is substantially radially symmetrical about central axis Y as best seen in FIGS. 3 and 4.

Figure 11:
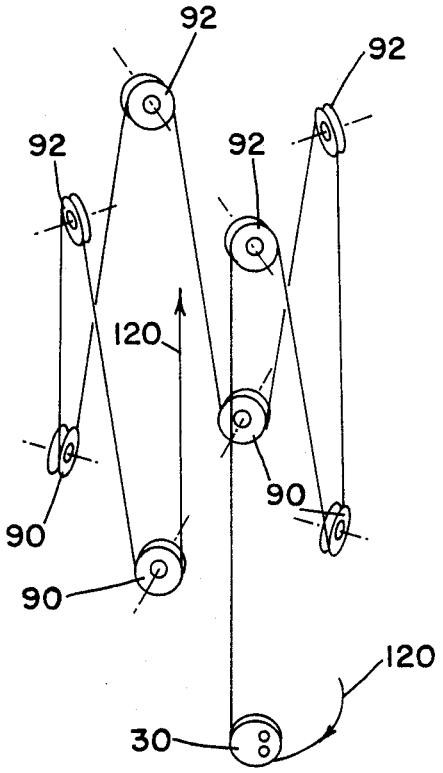

Strand 120 is carried in wound supply 122 on tubular spool 42 of bobbin 40. Means are provided to guide the strand first away from wound supply 122 in a direction perpendicular to central axis Y, then upwardly toward tension controller 80. Strand 120 then extends through tension controller 80 alternately between upper and lower strand pulleys 92 and 90, and finally away from strand carrier C through upper strand guide 130. In accordance with the invention, the path taken by strand 120 first to strand receiving surface 29 and then around shell 28 causes strand 120 continuously to leave strand supply 122 in a direction perpendicular to central axis Y as opposed to an angular direction from strand supply 122 directly to lower strand guide 30. A partial schematic view of the path taken by strand 120 is shown in FIG. 11.

Strand carrier C is thus seen to comprise an axially elongated, radially symmetrical assembly of components including spindle 20, bobbin 40, clutch 60, and tension controller 80. In accordance with the invention the strand carrier assembly is rotatably mounted on shuttle 10 by any suitable means enabling free rotation of the assembly as a whole about central axis Y. In the preferred embodiment, a rotatable mounting means is comprised of central post 110 and mounting platform 112. Mounting platform 112 is rigidly attached to shuttle 10 by bolts 114. Strand carrier C is carried on mounting platform 112 with base 22 of spindle 20 resting on raised surface 116 of mounting platform 112, and with central post 110 received within spindle shaft 24. Strand carrier C is freely rotatable with respect to shuttle 10 about axis Y, and is axially fixed along axis Y by top washers 100 and top bolt 102 engaged in threads at the top end of central post 110.

Disengagement of top bolt 102 enables the strand carrier assembly to be removed from the shuttle and the braiding machine as a complete unit. With the entire assembly removed from the shuttle connection, end member 26 can be axially removed upwardly through slots 34. Sleeve 94 can then be axially removed upwardly off of spindle shaft 24, carrying tension controller 80 and clutch means 60 upwardly on split ring 98. Bobbin 70 can then be removed and replaced with a replenished bobbin.

OPERATION

As described above, operation of braiding machine B causes shuttles 10 continuously to rotate in alternating directions with respect to workpiece W. Rotation of strand carrier C on mounting platform 112 will cause the strand carrier to rotate oppositely with respect to shuttle 10, and thus not to rotate with respect to workpiece W. As seen in FIG. 1, tension in strand 120 between workpiece W and upper strand guide 130 will tend to hold strand carrier C in a constant radial alignment with workpiece W.

Also, operation of braiding machine B causes strand carrier C to move alternately toward and away from workpiece W as strand carrier C follows alternating semi-circular paths in a revolution around workpiece W. Accordingly, the rate at which strand 120 is withdrawn must increase as strand carrier C moves radially away from workpiece W, and must decrease upon the return motion, both while remaining under a substantially constant tension to be wrapped around workpiece W by the overall revolving motion. As required, tension controller 80 operates to increase the rate of strand output only so much as to maintain a constant tension along the radially outward paths, and reverses to reduce the rate of output sufficiently to maintain a constant tension along the radially inward paths. In effect, tension controller 80 lets out and takes up slack in strand 120 between strand carrier C and workpiece W.

Figure 8:
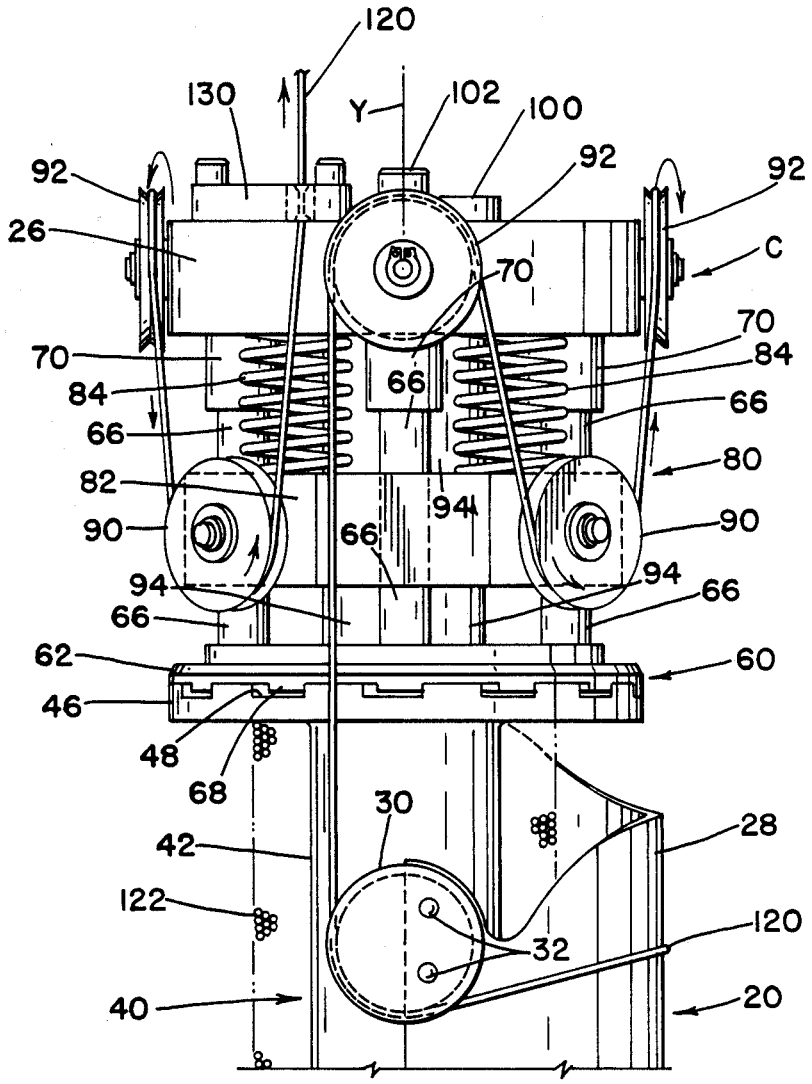
FIG. 8 is a partial side view in elevation of the upper portion of a strand carrier according to the invention.
Figure 9:
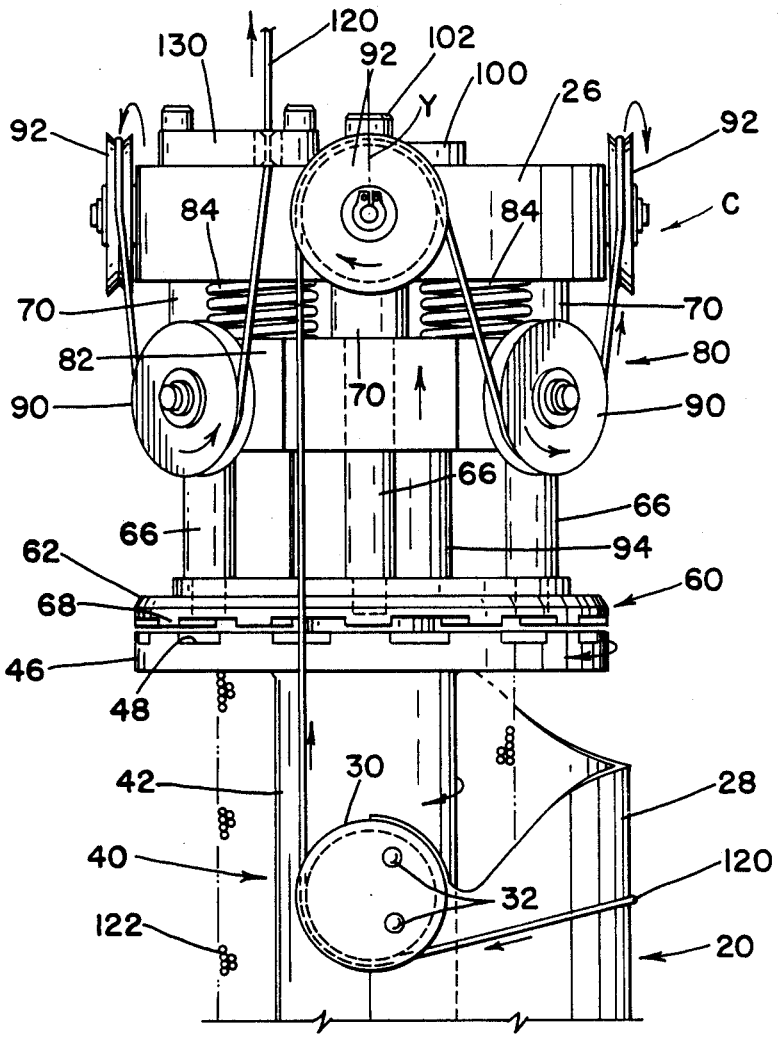
FIG. 9 is a partial side view in elevation of the upper portion of a strand carrier according to the invention.

As strand carrier C begins a path of travel moving radially away from workpiece W, the above described components take the axial positions shown in bold outline in FIG. 7. Importantly, bobbin 40 is constrained from rotation on spindle 20 by clutch plate 62, as are all the components constrained from relative rotation while being free to rotate together as a unit about central post 110. With bobbin 40 so constrained, strand 120 cannot unwind further from wound supply 122. As carrier C moves radially away from workpiece W the strand output is supplied from the lengths of strand 120 found between pulleys 90 and 92 of tension controller 80. As the initial output causes the lengths of strand 120 between pulleys 90 and 92 to decrease, floating member 82 is caused to move toward end member 26 along sleeve 94 against the biasing force of main springs 84 as shown in FIG. 8. Progressive movement of strand carrier C radially away from workpiece W will cause floating member 82 to move progressively through the raised positions shown in phantom view in FIG. 7 until the upper surface thereof reaches and contacts post heads 70. Further upward movement of floating member 82 will then lift post heads 70 and posts 66 upward against the biasing force of clutch springs 72, and thereby will lift clutch plate 62 up and out of engagement with bobbin flange 46 as shown in FIG. 9. Bobbin 40 will then rotate on spindle 20 to allow strand 120 to unwind from wound supply 122 and to supplement the output of tension controller 80.

At the completion of radial movement of strand carrier C away from workpiece W, carrier C will next begin an alternate path of travel radially toward workpiece W, and a certain amount of slack will momentarily be produced in the strand length between the carrier and the workpiece. This slack will immediately be taken up as main springs 84 force floating member 82 axially away from end member 26 to increase the length of strand 120 between upper and lower pulleys 92 and 90. In addition to taking up the slack in strand 120, expansion of main springs 84 will progressively counteract the loss of strand tension attendant to movement of carrier C radially toward workpiece W. Floating member 82 will move axially away from end member 26 until clutch posts 66 are lowered sufficiently for clutch plate 62 to become re-engaged with bobbin flange 46. At this point bobbin 40 is again constrained from rotation on spindle 20 and the output of strand 120 is supplied from the lengths between upper and lower pulleys 92 and 90. Floating member 82 will then fall away from post heads 70 until it again comes to rest at the lower position shown in FIG. 7, at which point strand carrier C has completed an alternate path of motion radially toward workpiece W and is about to begin a successive alternate path away therefrom.

The selection of main springs 84 will vary according to particular operating parameters desired at braiding machine B. Floating member 82 is seen to float an axial distance between clutch plate 62 and post heads 70 without disengaging clutch plate 66 from bobbin flange 46. Instead of the lower position shown in FIG. 7, main springs 84 may be selected to hold floating member 82 at another initial position anywhere within this axial floating distance as may be determined by a particular desired strand braiding tension. Also, withdrawal of a length of strand from the carrier will raise the floating member a corresponding distance which is inversely proportional to the total number of strand pulleys. For example, if eight pulleys are provided as shown, withdrawal of eight inches of strand length will raise floating member 82 only one inch. Therefore, selection of main springs 84 will vary according to the level of tension, and according to the amount of strand length to be withdrawn from tension controller 80 before bobbin 40 is released to supplement the strand output. The preferred embodiment includes four main springs of equal spring modulus, but other arrangements may be substituted therefor. Tension controller 80 is readily removed from strand carrier C upon release of top bolt 102 to provide access to main springs 84.

Other variations of the structure strand carrier C include substitution of the pulleys and the lower strand guide with apertures, eyelets, or any suitable means enabling the strand to be withdrawn from the bobbin and through the tension controller along a path providing a strand tension force between the floating member and the end member which is radially balanced to act substantially coincidently against the axial spring force without producing a moment therebetween, as does the path taken by the strand shown in FIG. 11. Also, in an alternate embodiment of the strand guide means, shell 28 may extend circumferentially around axis Y and bobbin 40 to any greater extent which permits passage of strand 120 between the radial extremities thereof and around strand receiving surface 29.

The invention has been described with reference to the preferred embodiment. Obviously modifications and alterations will occur to others upon the reading and understanding of this specification. It is intended to include all such modifications and alterations insofar as they come within the scope of the appended claims or equivalents thereof.

Having thus described the invention, it is claimed:

1. In a strand carrier for carrying and releasing a strand under tension in a braiding machine, said braiding machine having a plurality of shuttles moving around an elongated workpiece to be braided in a plane perpendicular to the axis of said workpiece, said carrier including a base, a bobbin rotatable with respect to said base, and bobbin having said strand wound thereon and extending therefrom to said workpiece, a clutch operatively associated with said bobbin to controllably permit rotation thereof with unwinding of said strand therefrom, a tension controlling mechanism operatively associated with said strand between said bobbin and said workpiece to maintain a generally constant tension in said strand between said carrier and said workpiece, said tension controlling mechanism controllably enabling said clutch to permit rotation of said bobbin in response to changes in strand tension, the improvement which comprises: said base, bobbin, clutch and tension controlling mechanism all being substantially symmetrical about a common axis extending perpendicular to said plane, said base being freely rotatably supported on a shuttle for rotation about said axis whereby said carrier is rotatable as a whole with respect to said shuttle about said axis; and, said rotation of said carrier being in response to said tension in said strand between said carrier and said workpiece.

2. A strand carrier as defined in claim 1, wherein said base, bobbin, clutch and tension controlling mechanism are separate modular components together comprising a modular strand carrier assembly, said modular components being releaseably held in axial succession along said common axis.

3. A strand carrier as defined in claim 1, wherein said tension controlling mechanism includes a first member fixed relative to said base, a second member axially shiftable along said common axis and spring biased away from said first member, strand guide means associated with each said first and second member such that said strand extends from said bobbin first to one of said strand guides, then to the remainder of said strand guides sequentially and alternately between said first and second members, with withdrawal of said strand from said strand carrier causing said strand to move said second member against said spring bias axially toward said first member, and said clutch being responsive to axial movement of said second member to controllably permit rotation of said bobbin with unwinding of said strand therefrom.

4. A strand carrier as defined in claim 1, further including a lower strand guide associated with said base, said lower strand guide having first means for directing said strand away from said bobbin in a direction perpendicular to said common axis, and second means for directing said strand away from said first means toward said tension controlling mechanism.

5. In a strand carrier for a braiding machine having a plurality of shuttles moving around an elongated workpiece to be braided and in a plane perpendicular to the axis of said workpiece with a strand under tension extending from the carrier to the workpiece, the improvement comprising said strand carrier including: an elongated assembly having a central axis perpendicular to said plane and two ends; a base at one of said ends and freely rotatably supported on a shuttle for rotation relative to said shuttle about said central axis; a bobbin coaxially associated with said base and rotatable about said central axis relative to said base, said bobbin having said strand wound thereon and extending therefrom to said workpiece; a clutch coaxially and operatively associated with said bobbin to controllably permit rotation thereof with unwinding of said strand therefrom; a tension controlling mechanism for controlling the tension in said strand between said carrier and said workpiece, said tension controlling mechanism being coaxially and operationally associated with said clutch; and, said rotation of said base relative to said shuttle being in response to tension in said strand between said carrier and said workpiece.

6. A strand carrier as defined in claim 5, wherein said base, bobbin, clutch, and tension controlling mechanism are each substantially radially symmetrical about said central axis.

7. A strand carrier as defined in claim 5, wherein said base, bobbin, clutch, and tension controlling mechanism are each separate modular components together comprising a modular strand carrier assembly, said modular components being releaseably held in axial succession along said central axis.

8. In a strand carrier for carrying and releasing a strand withdrawn therefrom under tension in a braiding machine, said carrier having an axis, a clutch, a bobbin, and a tension controlling mechanism, said bobbin being rotatable about said axis and having a supply of said strand wound thereon and extending therefrom to said tension controlling mechanism, said tension controlling mechanism controlling the tension on said strand withdrawn from said carrier, the improvement comprising: said tension controlling mechanism including a first member axially spaced from said bobbin and substantially radially symmetrical about said axis, said first member being axially fixed with respect to said bobbin; a second member axially spaced from said bobbin and said first member and substantially radially symmetrical about said axis, said seocnd member being shiftable along said axis and spring biased away from said first member; a plurality of strand guides associated with each said first and second members, said strand extending from said bobbin first to one of said strand guides, then to the remainder of said strand guides sequentially and alternately between said first and second members to provide a plurality of strand sections each having a length corresponding to the dsitance between said two axially spaced members, withdrawal of said strand from said carrier causing said second member to move against said spring bias axially toward said first member with corresponding reduction in length of said strand sections; and, said clutch being responsive to axial movement of said second member to alternately permit and prevent rotation of said bobbin.

9. The strand carrier as defined in claim 8, wherein said strand guides are disposed in radially symmetrical arrangements at said first and second members.

10. A strand carrier as defined in claim 8, wherein movement of said second member axially toward said first member causes withdrawal of said strand in an amount equal to the total reduction in length of said strand sections and directly proportional to the number of said strand guides.

11. A strand carrier as defined in claim 8, wherein said bobbin is rotatable relative to said tension controlling mechanism, and second member is adapted to move between a first position whereby said clutch is engaged with said bobbin to restrain rotation thereof and a second position whereby said clutch is disengaged from said bobbin to permit said independent rotation thereof.

12. A strand carrier as defined in claim 8, wherein the improvement further comprises a plurality of individual spring members disposed between said first and said second members.

13. A strand carrier as defined in claim 12, wherein the improvement further comprises means adapted to releasably retain said spring members between said first and second members.

14. A strand carrier as defined in claim 13, wherein said retaining means comprises spring pockets formed as opposed axially extending recesses in said first and second members.

15. A strand carrier as defined in claim 13, wherein said spring pockets are disposed in a relationship radially symmetrical about said axis.

* * * * *